US006273176B1

(12) United States Patent
Didion

(10) Patent No.: US 6,273,176 B1
(45) Date of Patent: Aug. 14, 2001

(54) INTERLOCKING LINER FOR A CASTING SHAKE-OUT UNIT

(75) Inventor: Michael S. Didion, St. Charles, MO (US)

(73) Assignee: Didion Manufacturing Company, St. Peters, MO (US)

( * ) Notice: Subject to any disclaimer, the term of this patent is extended or adjusted under 35 U.S.C. 154(b) by 0 days.

(21) Appl. No.: 09/398,286

(22) Filed: Sep. 20, 1999

(51) Int. Cl.[7] ..... B22D 29/00

(52) U.S. Cl. ..... 164/404; 164/131; 164/269; 403/375; 403/345

(58) Field of Search ..... 164/404, 269, 164/131, 401, 5; 403/378, 379.4, 380, 345, 375, 335

(56) References Cited

U.S. PATENT DOCUMENTS

| | | | |
|---|---|---|---|
| 3,998,262 | 12/1976 | Didion | 164/131 |
| 4,502,808 | 3/1985 | Didion et al. | 403/24 |
| 5,638,887 | 6/1997 | Didion | 164/269 |
| 5,638,890 | 6/1997 | Didion | 164/404 |

*Primary Examiner*—Tom Dunn
*Assistant Examiner*—Kevin McHenry
(74) *Attorney, Agent, or Firm*—Paul M Denk

(57) ABSTRACT

A tumbling unit such as a casting shake-out unit, rotary media drum, sand reclaimer or the like, is provided. The tumbling unit includes a cylindrical outer shell and a cylindrical inner shell. The inner liner is formed of a series of interfitting segments. The segments each have an inner surface, an outer surface, side edges, a front edge, a back edge, and rifling extending from the outer surface. The side edges of the segments have a groove formed therein which extends the length of said the edges. The grooves of neighboring segments define channel between the segments. The pin is received in the channel to urge the neighboring segments apart to form a tight interfit among the segments in a row of the liner. The retaining pin has a body having side surfaces, a top surface, and a bottom surface. A rib extends along each side surface which is shaped and sized to be received in the grooves of the neighboring segments. An arm extends upwardly from the pin body top surface. The pin arm conforms in shape and size to the side profile of the rifling, and is positioned on the pin body to be in alignment with the rifling of the adjacent segments, to form a continuous rifling on said liner.

5 Claims, 4 Drawing Sheets

INTERLOCKING LINER FOR A CASTING SHAKE-OUT UNIT

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to casting shake-out units used to separate or remove sand from castings, and in particular, to a liner which forms the inner surface of the shake-out unit.

In the formation of a tumbling mill, such as a casting shake-out unit, rotary separator, media drum, material drier, lump crusher reclaimer, blending drum, sand screen, or the like, it is desirable to form the inner surface of the mill from segments. Thus, when individual segments wear out, they can be replaced easily and rapidly without the need to incur a significant amount of downtime or expense. An examples of a shake-out unit having segmented inner liners is shown in U.S. Pat. No. 3,998,262 which is assigned to the same assignee as the present invention, and which is incorporated herein by reference. As set forth in that patent, the inner cylinder forming the inner surface of the unit is formed from a series of interconnected modular components. The operation of that unit, for its intended purpose, has performed highly satisfactorily. However, when the casting shake-out unit is operated continuously, the wear on the components causes the components or segments to gradually loosen. This requires a retightening of the entire formed inner surface. This retightening operation requires that the operator incur a significant amount of down time.

It is desirable for the mill to operate for a longer period before the segments begin to loosen and separate. In U.S. Pat. Nos. 4,502,808, 5,638,887, and 5,638,890, all of with are assigned to the same assignee as the present invention and incorporated herein by reference, the side edges of the segments are grooved to define a channel between neighboring segments. A pin or bar is inserted in the channel. In a completed lining, the bars tend to urge the segments apart, thus creating a tight fig in the completed cylindrical lining. These have also worked well. However, the pins and the interlocking of the liner segments can still be improved.

BRIEF SUMMARY OF THE INVENTION

A tumbling unit such as a casting shake-out unit, rotary media drum, sand reclaimer or the like, is provided. The tumbling unit includes a cylindrical outer shell and a cylindrical inner shell. The inner liner is formed of a series of interfitting segments. The segments each have an inner surface, an outer surface, side edges, a front edge, a back edge, and rifling extending from the outer surface. The side edges of the segments have a groove formed therein which extends the length of said the edges. The grooves of neighboring segments define channel between the segments. To enable the segments to interfit, the segments include tongues on their segment front and back edges and cutouts in their comers. The tongues and cutouts are shaped and positioned to enable the segments to interfit with each other.

The pin is received in the channel to urge the neighboring segments apart to form a tight interfit among the segments in a row of the liner. The retaining pin has a body having side surfaces, a top surface, and a bottom surface. A rib extends along each side surface which is shaped and sized to be received in the grooves of the neighboring segments. An arm extends upwardly from the pin body top surface. When the pin is placed between two neighboring segments, it separates the segments. The pin arm conforms in shape and size to the side profile of the rifling, and is positioned on the pin body to be in alignment with the rifling of the adjacent segments, to form a continuous rifling on said liner. The pins have cutouts at opposite ends thereof which conforming generally in size and shape to the profile of the segment cutouts.

In a second embodiment, the segments include a first and a second side, and a front and a back side. A first side flange extends along the first side; a second side flange extends along the second side; a front flange extends along the front side; and a back side flange extends along the back side. The flanges all have a width equal to approximately one-half the width of the segment body between the inner and outer surfaces of said segment body. The first side flange and bottom flange have a surface generally flush with one of the inner and outer surfaces of the segment; and the second side flange and the top flange having a surface generally flush with the other of the inner and outer surfaces of said segment. This gives the segment the appearance of two rectangles being placed on top of each other, with one rectangle being diagonally offset from the other rectangle.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention.

Figure 1:
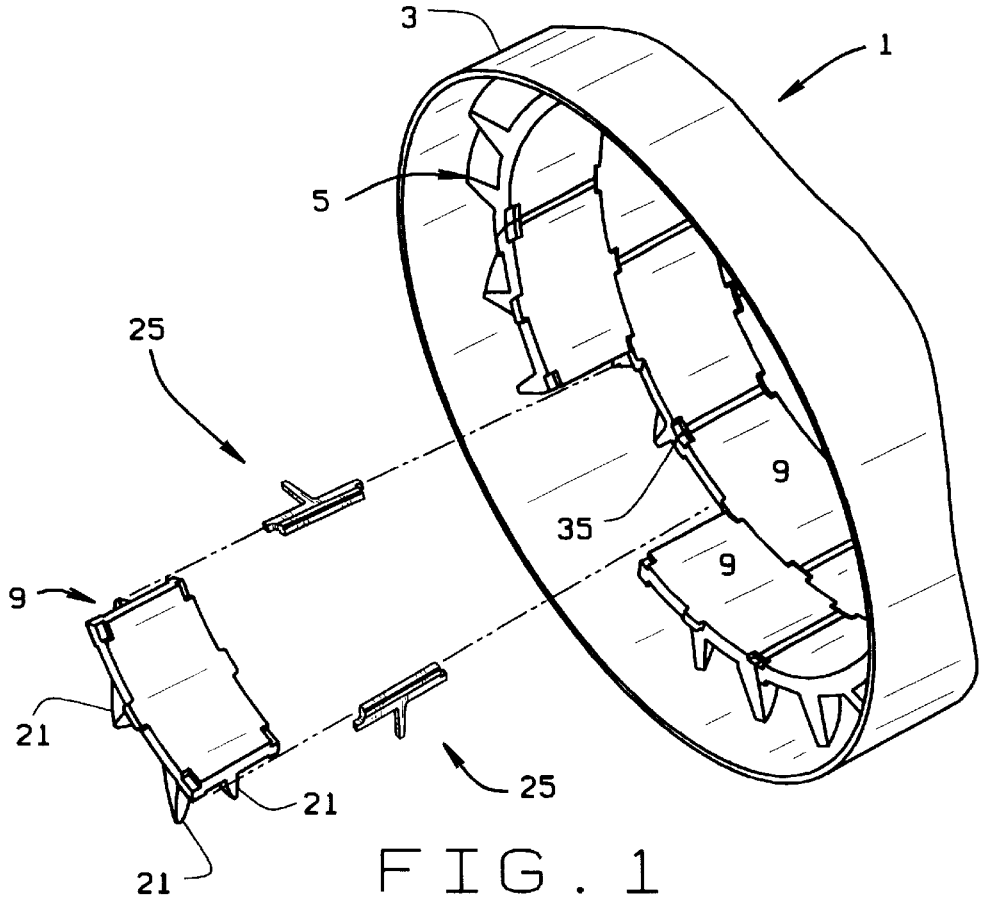
FIG. 1 is a partial perspective end view of a tumbling unit which is partially exploded to show one segment and a pair of retaining pins removed and with inner riflings not shown for purposes of clarity.

A tumbling mill 1 is shown generally in FIG. 1. Tumbling mill 1 is preferably a mill constructed and operated in the manner disclosed in the above noted U.S. Pat. No. 3,998,262 to remove sand from casting by tumbling the castings. As shown, the mill 1 generally includes an outer cylinder 3 and an inner cylinder 5. The inner cylinder 5 is of a smaller diameter than the outer cylinder 3, and the two cylinders define a space 7 between the cylinders. The inner liner or cylinder 5 is made of a plurality of interlocking segments 9 which fit together to form the cylinder 5. Importantly, and as will be described below, the segments 9 positively lock together so that segments will not fall out of the lining as they wear. This advantageously increases the time the mill may be continuously operated before it has to be shut down to tighten the inner liner 5.

The segment 9 is similar to the segments described in the above noted U.S. Pat. No. 5,638,890. Each segment 9 includes a generally arcuate body 11 having an inner surface 13, an outer surface 15, side edges 17, and front and back edges 19. Each segment preferably covers approximately 35°–40° of arc. To space the segments 9, and hence, the inner cylinder 5, from the outer cylinder 3, each segment 9 has diagonally extending ribs or rifling 21 formed its outer surface 15. The ribs 21 are positioned on segment 9 so that when a plurality of the segments are connected to form inner cylinder 5, the ribs from one segment abut respective ribs from neighboring segments to provide continuous rifling along the cylinder surface. As set forth in the prior patents, the inner cylinder 5 is preferably perforated so that the sand which is separated from the castings may fall into the space 7 between the inner and outer cylinders. The segments 9 thus have a plurality of holes or perforations 22 formed therein to allow sand to fall into the space 7 between the inner and outer cylinders. A slot or groove 23 is formed along side edges 17 to receive a pin 25 which spaces the segments apart in the completed inner cylinder to tighten the fit between the segments of the inner cylinder. The pin 31 is described in more detail below. The groove 23 extends the full length of the side edges 17.

Figure 4:
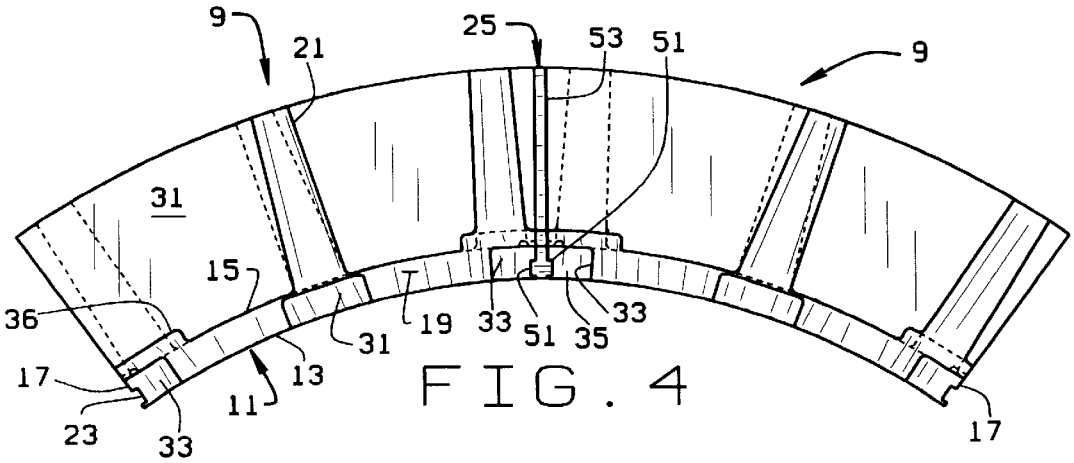
FIG. 4 is an end elevational view of a pair of segments adjacent each other with a pin positioned between them.
Figure 5:
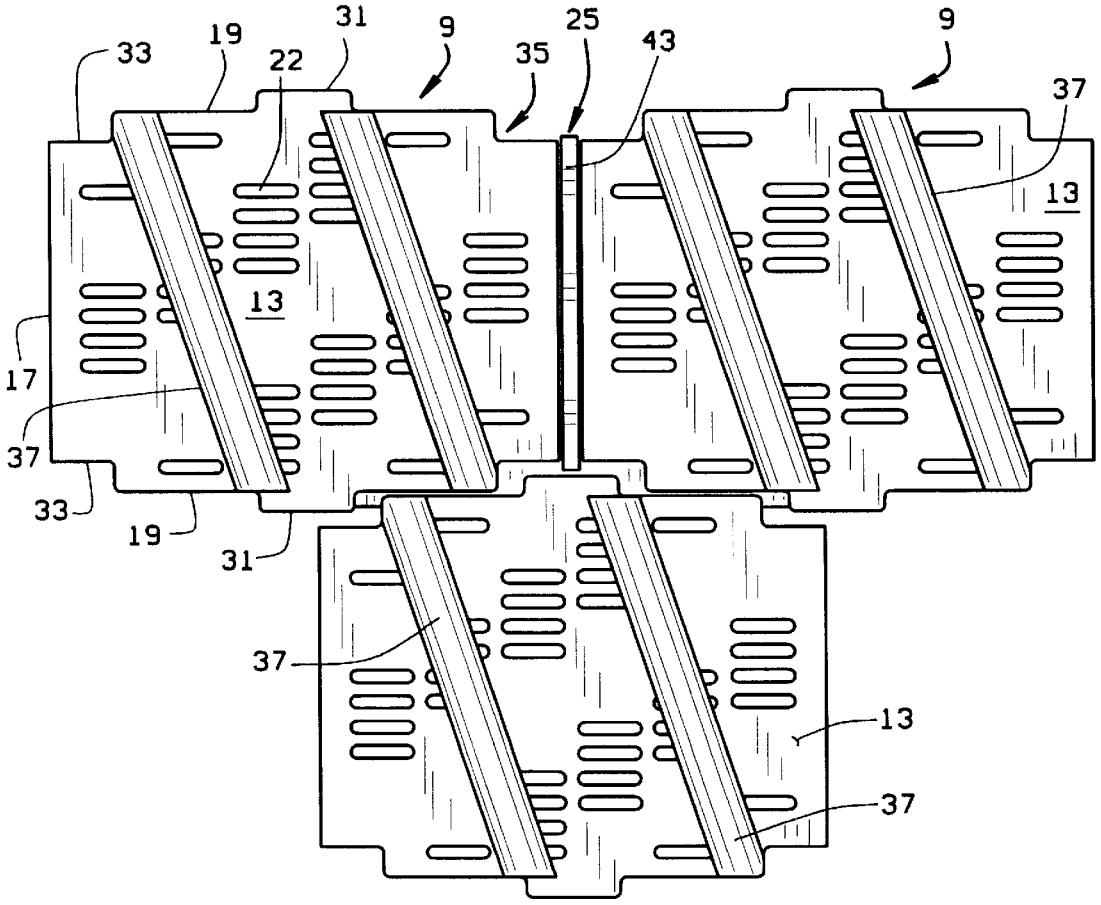
FIG. 5 is an inner plan view of three segments positioned together.

To enable the segments 9 to interlock with each other, each segment includes a tongue 31 extending from the approximate center of the front and back edges 19 and generally rectangular cutouts 33 at the four corners of the liner body 11. The cutouts 33 define pockets 35 when two segments 9 are placed adjacent each other along their side edges 17. The formed pocket receives the tongue 33 of a further segment 9 which is placed adjacent the two segments along the front and back edges 19 of the segments, as seen in FIG. 5. The tabs 31 extend the full width of the body 11 between the inner and outer surfaces 13 and 15. The body, however, includes a raised portion 36 on the outer surface 15 which covers the cutouts 33, as seen in FIG. 4. Thus, the pockets 35 are closed on one side. When the liner 5 is assembled, the covers 36 rest on the tongues 31, thereby interlocking the segments 9 of adjacent different rows of segments.

As seen in FIG. 5, the segments 9 including rifling 37 on their inner surfaces 13. The rifling is not shown in FIG. 4 for purposes of clarity. In the completed lining, the rifling helps move castings through the mill. The rifling 37 is formed on the segments so that the rifling of one row of liner segments is off-set from the rifling of an adjacent row of liner segments. Thus, the rifling or ribs 37 do not form continuous ribs or rifling along the inner surface of the liner 5.

Figure 2:
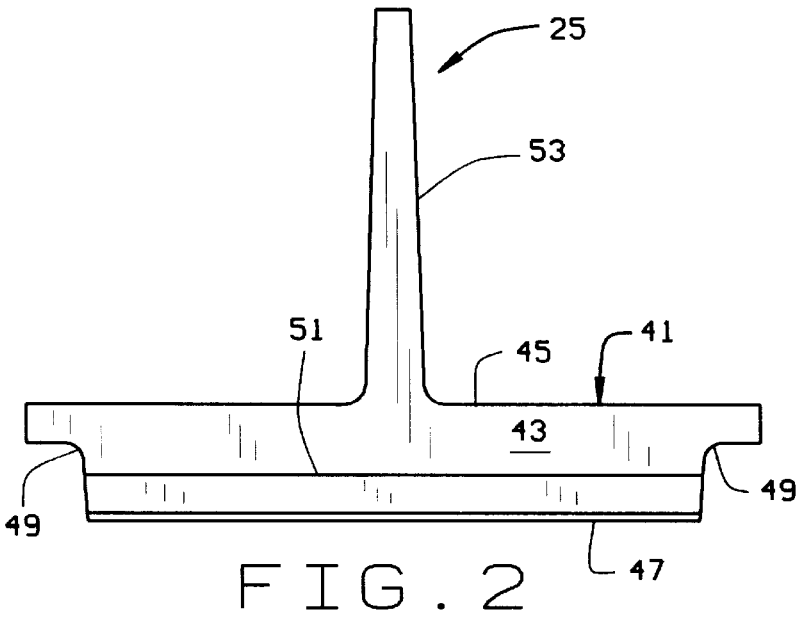
FIG. 2 is a side elevational view of the pin.
Figure 3:
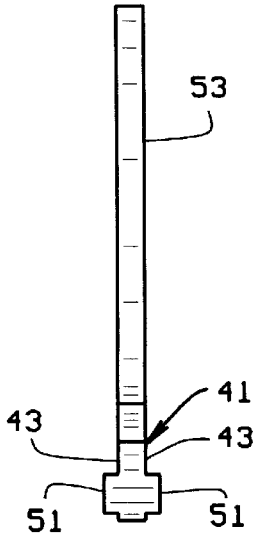
FIG. 3 is an end elevational view of the pin.

The retaining pins 25 are positioned between the side edges 17 of adjacent or neighboring segments 9. The pins 25 are shown in more detail in FIGS. 2 and 3. Each pin 25 includes an elongate, generally rectangular body 41 having side walls 43, a top surface 45, and a bottom surface 47. The body 41 has a length substantially equal to the length of the segment side 17. So that the pin will not interfere with the interlocking of the segments 9, the pin body includes a cut out 49 on either end of the body. The cutout 49 corresponds in size and shape to the side profile of the cutouts 33 in the segments 9.

A rib 51 extends along each side surface 43 of the pin body 41. The ribs 51 are sized and shaped to be received in the grooves 23 in the segment sides 17. Additionally, an arm 53 extends up from the pin body top surface 45. As seen in FIG. 4, the arm 53 is positioned on the pin body 41 such that it is aligned with the ribs 21 of the liner segments 9 when the liner 5 is assembled. Thus, the arm 53, as seen, is generally trapezoidal in side elevation (FIG. 2), and rectangular in front elevation (FIG. 3), which corresponds in size and shape to the side profile of the segment ribs 21. Thus, the ribs 21 provide for a smooth transition between the ribs 21 of the segments 9, as well as of the inner surfaces 13 of the segments 9.

When the segments 9 are interconnected, the pins 25 tighten the liner or inner cylinder 5, as set forth in the above noted U.S. Pat. No. 4,502,808, to lengthen the time before the segments come loose from each other due to continuous operation of the mill. The interconnection of the segments, in turn, prevents a segment from falling out when the pin wears. Thus, if a pin 25 wears, the interaction between the tongue 31 and its associated pocket 35 will prevent the segment from falling out from the inner cylinder 5. Although the segment will be loose when the pin wears through, the segment will not fall out. This will allow the operator time to normally shut down the mill to insert a new pin or a new segment.

Figure 6:
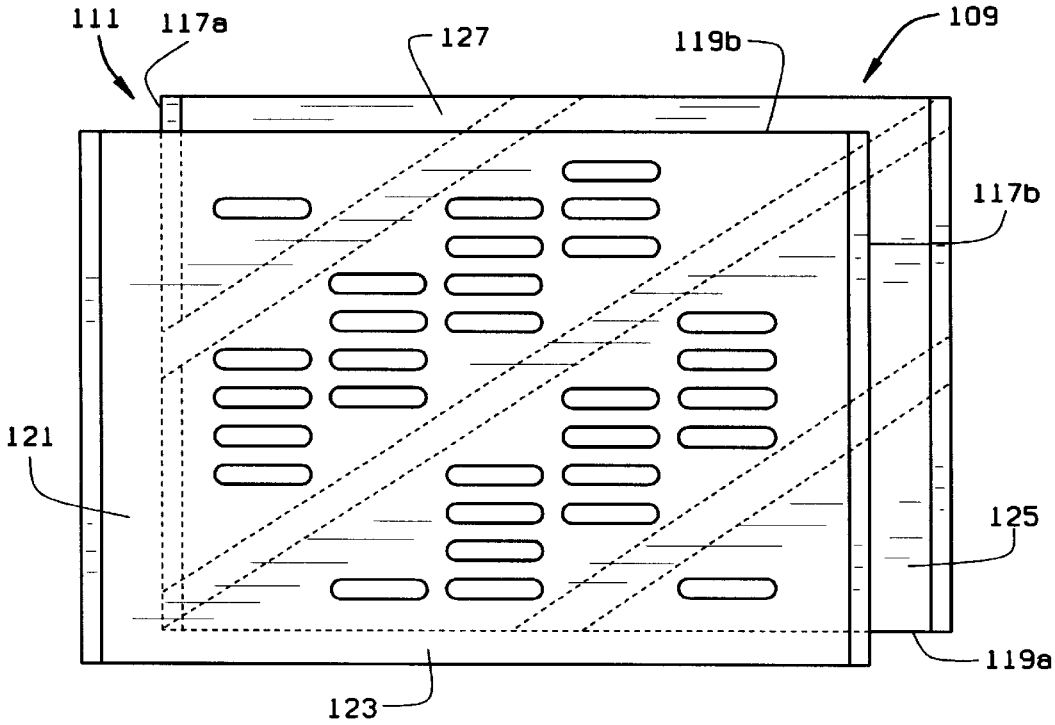
FIG. 6 is a top plan view of an alternative embodiment of the inner liner segment.
Figure 7:
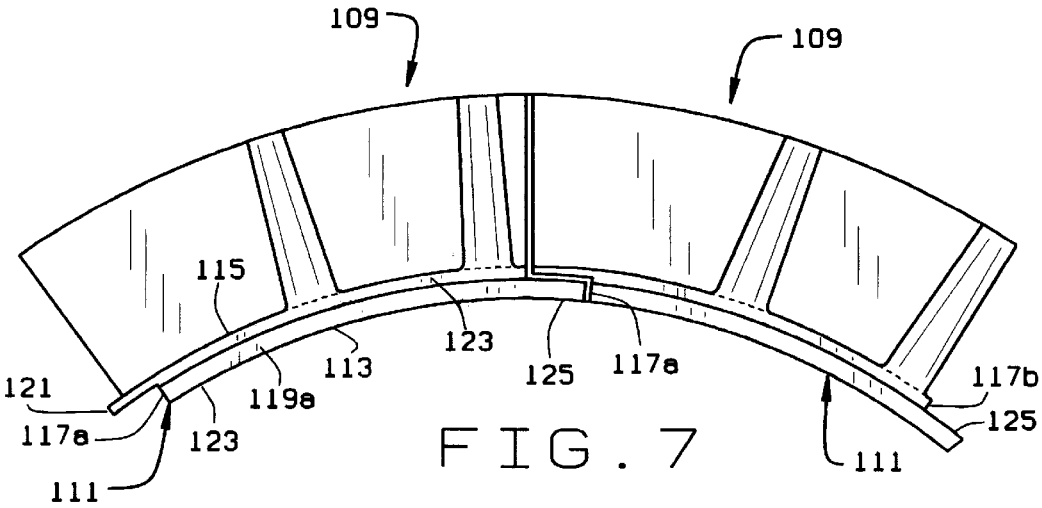
FIG. 7 is a side elevational view of a pair of segments of FIG. 6 adjacent each other.
Figure 8:
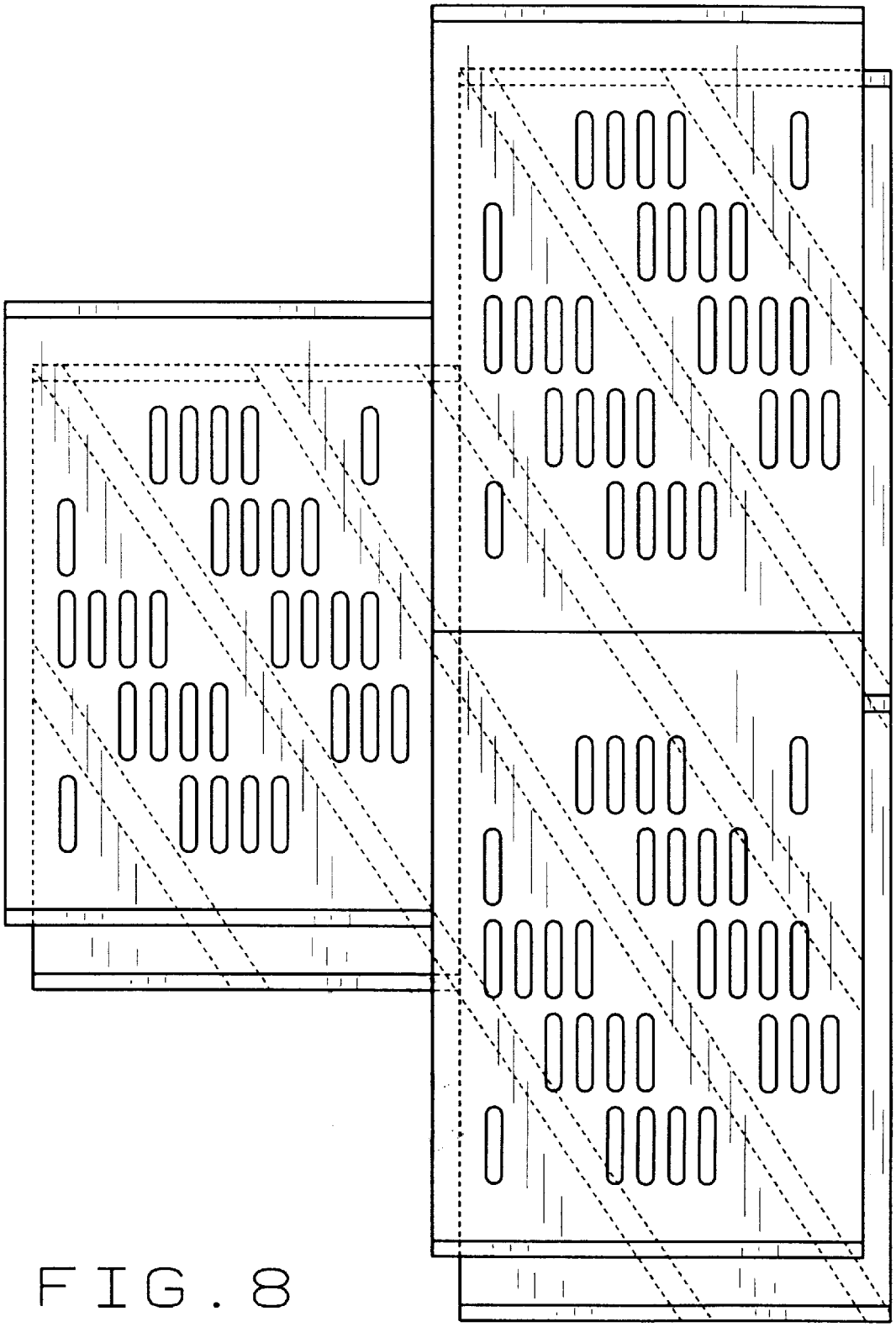
FIG. 8 is an inner plan view of three segments of FIG. 6 positioned together.

A second embodiment of the segments is shown in FIGS. 6–8. The segments 109 include a generally arcuate body 111 having an inner surface 113, an outer surface 115, a first side edge 117*a*, a second side edge 117*b*, a front edge 119*a*, and a back edge 119*b*. A first side flange 121 extends from the body along side 117*a* and a front flange 123 extends along the front edge 119*a*. A second side flange 125 extends along side 117*b* and a back flange 127 extends along the back 119*b*. The flanges 121, 123, 125, and 127 have a top to bottom thickness of about ½ of the thickness of the segment body 111 between its inner and outer surfaces. The flanges 121 and 123 both have top surfaces which are continuations of the outer surface 115 of the segment body; and the flanges 125 and 127 have bottom surfaces which are continuations of the inner surface 113 of the segment body. Thus, as seen in FIG. 6, the body, in top plan, appears as two rectangles placed on top of each other and diagonally offset from each other.

To assemble the inner cylinder from the segments 109, the segments are assembled with their flanges in overlapping relationship, as shown in FIGS. 7 and 8. As with the segments 9, the overlapping relationship of the flanges of the segments 109 will prevent the segments from falling out of the inner cylinder as the segments become worn. Although not shown in the drawings, grooves can be formed in the edge of the flange 121 and in the body side 117*b* to accept the pin 25.

As can be appreciated, the segments of the present invention will cooperate with each other to prevent a segment from separating from the lining when a pin wears or breaks. Although the segment may be somewhat loose, the mill 1 will still be operable, at least for a short period of time, before the segment must be replaced. This will allow for a normal shut down of the machine, rather than an emergency shut down of the machine which would be needed if the segment did separate from the lining. The pin will provide a smooth and continuous transition between the plates, so that the castings and sand see only continuous substantially uninterrupted inner and outer surfaces for the lining 5 and continuous substantially uninterrupted rifling along the liner outer surface.

As various changes could be made in the above constructions without departing from the scope of the invention, it is intended that all matter contained in the above description or shown in the accompanying drawings shall be interpreted as illustrative and not in a limiting sense.

What is claimed is:

1. A tumbling unit such as a casting shake-out unit, rotary media drum, sand reclaimer or the like, the tumbling unit comprising:

a cylindrical outer shell;

a cylindrical liner positioned within said outer shell, said liner being formed of a series of interfitting segments, said segments having an inner surface, an outer surface, side edges, a front edge, a back edge, and rifling extending from said outer surface; the side edges of the segments having a groove formed therein and extending the length of said side edges, the grooves of neighboring segments defining channel between neighboring; and an elongate retaining pin received in said channel to urge adjacent segments apart to form a tight interfit among the segments in a row of said liner, said retaining pin including a body having side surfaces, a top surface, and a bottom surface; a rib extending along each side surface, said ribs being shaped and sized to be received in the grooves of the adjacent segments; and an arm extending upwardly from said pin body top surface; said pin separating adjacent liner segments, said pin arm conforming in shape to, and being in alignment with, the rifling of the adjacent segments, to form a continuous rifling on said liner.

2. The tumbling unit of claim 1 wherein said liner segments include tongues on said segment front and back edges, and cutouts in corners of said segments; said tongues and cutouts being shaped and positioned to enable said segments to interfit with each other; said pins having cutouts at opposite ends thereof; said pin cutouts conforming generally to the profile of the segment cutouts.

3. A retaining pin for use in a cylindrical tumbling unit to force a tight interfit between neighboring segments of the tumbling unit; said neighboring segments each having an side edge, a groove formed in said edge, and rifling on an outer surface of said segments; the grooves of neighboring segments defining a channel;

said retaining pin including a body having side surfaces, a top surface, and a bottom surface; a rib extending along each side surface, said ribs being shaped and sized to be received in the grooves of neighboring segments; and an arm extending upwardly from said pin body top surface; said pin separating neighboring liner segments, said pin arm conforming in shape to, and being in alignment with, the rifling of the neighboring segments, to form a continuous rifling on said liner.

4. A casting shake-out unit including an outer cylinder and an inner cylinder; said inner cylinder being formed from a plurality of segments which interfit with each other; each segment including:

a body having an inner surface, an outer surface, a first side edge, a second side edge opposite said first side edge, a front edge, and a back edge;

a first side flange extending along said first side; a second side flange extending along said second side; a front flange extending along said front side; and a back side flange extending along said back side; said flanges all having a width equal to approximately one-half the width of said segment body between said inner and outer surfaces of said segment body; said first side flange and said bottom flange having a surface generally flush with one of the inner and outer surfaces of said segment; and said second side flange and said top flange having a surface generally flush with the other of said inner and outer surfaces of said segment.

5. A segment for forming an inner lining of a casting shake-out unit, said segment being shaped and configured to interfit with neighboring segments; said segment including:

a first side flange extending along said first side; a second side flange extending along said second side; a front flange extending along said front side; and a back side flange extending along said back side; said flanges all having a width equal to approximately one-half the width of said segment body between said inner and outer surfaces of said segment body; said first side flange and said bottom flange having a surface generally flush with one of the inner and outer surfaces of said segment; and said second side flange and said top flange having a surface generally flush with the other of said inner and outer surfaces of said segment.

* * * * *